US009278561B2

(12) United States Patent
Kato

(10) Patent No.: US 9,278,561 B2
(45) Date of Patent: Mar. 8, 2016

(54) PRINTING APPARATUS AND PRINTING METHOD

(71) Applicant: CANON KABUSHIKI KAISHA, Tokyo (JP)

(72) Inventor: Hiroaki Kato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/875,518

(22) Filed: May 2, 2013

(65) Prior Publication Data

US 2013/0307902 A1 Nov. 21, 2013

(30) Foreign Application Priority Data

May 16, 2012 (JP) ..... 2012-112684

(51) Int. Cl.

| | |
|---|---|
| ***B41J 2/165*** | (2006.01) |
| ***B41J 23/14*** | (2006.01) |
| ***B41J 19/20*** | (2006.01) |
| ***B41J 23/02*** | (2006.01) |

(52) U.S. Cl.
CPC ..... *B41J 23/14* (2013.01); *B41J 19/202* (2013.01); *B41J 23/02* (2013.01)

(58) Field of Classification Search
None
See application file for complete search history.

(56) References Cited

U.S. PATENT DOCUMENTS

| | | | | |
|---|---|---|---|---|
| 7,944,582 | B2 | 5/2011 | Kato | |
| 2006/0147237 | A1 | 7/2006 | Hayashi et al. | |
| 2013/0194336 | A1 * | 8/2013 | Iwadate | 347/14 |

FOREIGN PATENT DOCUMENTS

| | | | |
|---|---|---|---|
| JP | 2002-137469 | A | 5/2002 |
| JP | 2005-178334 | A | 7/2005 |
| JP | 2006-095697 | A | 4/2006 |
| JP | 2012-086425 | A | 5/2012 |

OTHER PUBLICATIONS

Japanese Office Action issued in corresponding Japanese Application No. 2012-112684 dated Jan. 5, 2016.

* cited by examiner

*Primary Examiner* — Alejandro Valencia
(74) *Attorney, Agent, or Firm* — Fitzpatrick, Cella, Harper & Scinto

(57) ABSTRACT

The present invention provides a printing apparatus which prints while reciprocating a carriage by a motor, comprising a gear member configured to be attached to a rotor of the motor, a belt configured to be attached to the carriage, to include unevenness corresponding to teeth of the gear member, and to be suspended to be engaged with the gear member, a storage unit configured to store data of a signal for suppressing a velocity fluctuation of the carriage when no tooth jumping occurs between the gear member and the belt, a detection unit configured to detect generation of the tooth jumping from the velocity fluctuation of the carriage during movement of the carriage, and a correction unit configured to correct the velocity fluctuation of the carriage by using the stored data of the signal for suppressing when the tooth jumping occurs.

6 Claims, 8 Drawing Sheets

FIG. 7

PHASE SHIFT [deg]

| ORDER \ TOOTH JUMPING COUNT | 1 | 2 | 3 | 4 | 5 | 6 | 7 | 8 | 9 | 10 | 11 | 12 |
|---|---|---|---|---|---|---|---|---|---|---|---|---|
| 24 | 0 | 0 | 0 | 0 | 0 | 0 | 0 | 0 | 0 | 0 | 0 | 0 |
| 12 | 180 | 0 | 180 | 0 | 180 | 0 | 180 | 0 | 180 | 0 | 180 | 0 |
| 8 | 120 | 240 | 0 | 120 | 240 | 0 | 120 | 240 | 0 | 120 | 240 | 0 |
| 6 | 90 | 180 | 270 | 0 | 90 | 180 | 270 | 0 | 90 | 180 | 270 | 0 |
| 4 | 60 | 120 | 180 | 240 | 300 | 0 | 60 | 120 | 180 | 240 | 300 | 0 |

PRINTING APPARATUS AND PRINTING METHOD

BACKGROUND OF THE INVENTION

1. Field of the Invention

The present invention relates to a printing apparatus and a printing method and, more particularly, to control of a carriage motor having periodical torque fluctuations.

2. Description of the Related Art

Recently, demand is growing for higher image qualities of printing apparatuses. Measures to increase image quality include increasing the printing medium conveyance precision, printhead printing precision (for example, for an inkjet printer, the inkjet discharge amount and discharge timing), and the operation precision of a carriage on which a printhead is mounted.

Of these measures, here attention is paid to the carriage operation precision. In general, an inkjet printer or the like simultaneously performs carriage operation control and printhead printing control because the printhead prints while the carriage operates. Thus, the carriage operation precision based on a control signal from a controller influences the printing precision.

In most cases, the carriage uses a motor as a driving source. The driving force of the motor is generally transmitted by engaging a gear-shaped pulley attached to the motor shaft with a belt to which the carriage is attached. A DC brushless motor is often used as the motor, and periodical torque fluctuations (cogging torque) are generated due to a structural factor. Owing to the torque fluctuations, the rotation speed of the motor fluctuates, and the carriage velocity becomes unstable, resulting in poor printing precision.

To solve this, Japanese Patent Laid-Open No. 2005-178334 discloses a technique for suppressing velocity fluctuations. More specifically, a periodic signal is generated to cancel velocity fluctuations caused by the cogging torque, and motor driving is controlled in accordance with the signal.

In Japanese Patent Laid-Open No. 2005-178334, the periodic signal is generated based on the carriage position. The relationship between the motor rotation position and the carriage position may change when, for example, a foreign substance collides with the carriage to generate tooth jumping between the belt and the pulley. In this case, the relationship between the periodic signal timing and the motor rotation position deviates from an optimum state, velocity fluctuations cannot be appropriately canceled, and the periodic signal needs to be generated again. Also, in this case, the user cannot use the printing apparatus while parameters are identified, generating the downtime of the apparatus.

SUMMARY OF THE INVENTION

Accordingly, the present invention is conceived as a response to the above-described disadvantages of the conventional art.

For example, a printing apparatus and a printing method according to this invention are capable of quickly, efficiently suppressing velocity fluctuations of a carriage.

According to one aspect of the present invention, there is provided a printing apparatus which prints while reciprocating, by a motor in a predetermined direction, a carriage on which a printhead is mounted, comprising: a gear member configured to be attached to a rotor of the motor; a belt configured to be attached to the carriage, include unevenness corresponding to teeth of the gear member, and be suspended to be engaged with the gear member; a storage unit configured to store data of a signal for suppressing a velocity fluctuation of the carriage when no tooth jumping occurs between the gear member and the belt; a detection unit configured to detect generation of the tooth jumping from the velocity fluctuation of the carriage during movement of the carriage; and a correction unit configured to correct the velocity fluctuation of the carriage by using the stored data of the signal for suppressing when the tooth jumping occurs.

According to one aspect of the present invention, there is provided a printing method applied to a printing apparatus which prints while reciprocating, by a motor in a predetermined direction, a carriage on which a printhead is mounted, the apparatus including: a gear member configured to be attached to a rotor of the motor; a belt configured to be attached to the carriage, include unevenness corresponding to teeth of the gear member, and be suspended to be engaged with the gear member; and a storage unit configured to store data of a signal for suppressing a velocity fluctuation of the carriage when no tooth jumping occurs between the gear member and the belt, the method comprising: detecting generation of the tooth jumping from the velocity fluctuation of the carriage during movement of the carriage; and correcting the velocity fluctuation of the carriage by using the stored data of the signal for suppressing when the tooth jumping occurs.

Further aspects of the present invention will become apparent from the following description of exemplary embodiments with reference to the attached drawings.

BRIEF DESCRIPTION OF THE DRAWINGS

FIG. 7 is a table showing a phase shift between each cogging torque component and a corresponding periodic signal with respect to the tooth jumping count.

DESCRIPTION OF THE EMBODIMENTS

Figure 1:
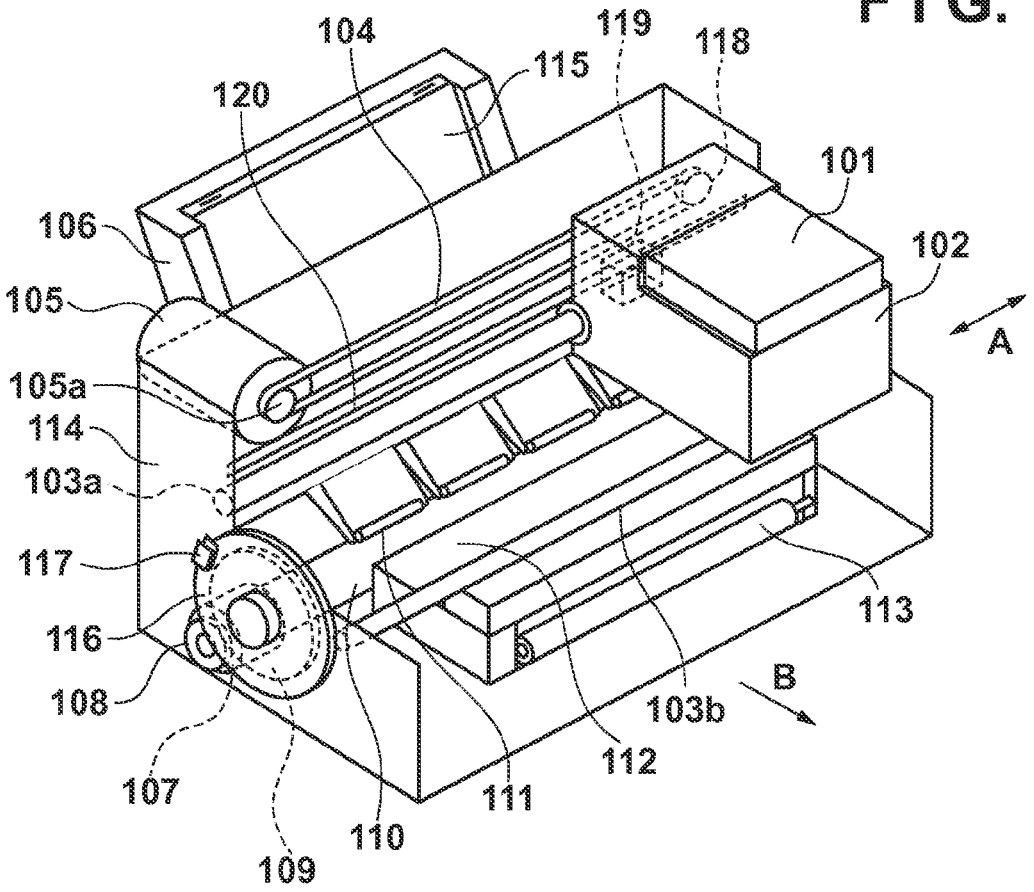
FIG. 1 is a perspective view showing an inkjet printing apparatus according to an embodiment of the present invention.

A printing apparatus using an inkjet printing method will be exemplified as a preferred embodiment of the present invention with reference to the accompanying drawings. The printing apparatus may be, for example, a single-function printer having only the printing function, or a multi-function printer having a plurality of functions such as the printing function, FAX function, and scanning function. The printing apparatus may be a manufacturing apparatus which manufactures a color filter, electric device, optical device, micro structure, or the like by a predetermined printing method.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

In the following description, the same reference numerals denote the same parts, and a repetitive description thereof will be omitted.

<Overall Arrangement of Inkjet Printing Apparatus>

FIG. 1 is a perspective view showing an inkjet printing apparatus (to be referred to as a printing apparatus hereinafter) according to the embodiment.

Printing paper 115 serving as a printing medium is stacked in a paper feed base 106 during standby for printing, and is fed by a feeding roller (not shown) at the start of printing. The fed printing paper 115 is pinched between a conveyance roller 110 and pinch rollers 111. The pinch rollers 111 are pressed against the printing paper by pinch roller springs (not shown). In this state, a conveyance DC motor 107 serving as a DC conveyance motor 107 is driven to rotate the conveyance roller 110 (and associate and rotate the pinch rollers 111) via a gear array (a motor gear 108 and conveyance roller gear 109), thereby conveying the printing paper 115 in a conveyance direction (sub-scanning direction) B by a predetermined conveyance amount. The conveyance amount is managed by detecting the rotation amount of the conveyance roller 110 serving as a rotation member by using a pattern portion formed on a code wheel 116 press-fitted on the conveyance roller gear 109, and an encoder sensor 117. When a printing target portion of the printing paper 115 reaches a platen 112, the conveyance is stopped and printing is performed at this portion. After printing, the printing paper 115 is conveyed again, and conveyance and printing are alternately executed (that is, printing is performed while intermittently conveying the printing paper 115). Upon completion of a series of printing operations, a discharge roller 113 discharges the printing paper 115. Although the embodiment uses the printing paper 115 as a printing medium, roll paper may be used in accordance with the arrangement and purpose.

A printhead 101 is mounted on a carriage 102 including an encoder sensor 119, and a belt 104 is attached to the carriage 102. The belt 104 is suspended between a pulley 105*a*, and a driven pulley 118 which is arranged at a position opposite to a carriage motor 105 in a main-scanning direction A. With this arrangement, the carriage motor 105 drives the carriage 102. The structure of the carriage motor 105, and the suspension structure between the belt 104 and the pulley 105*a* will be described in detail later. A guide shaft 103*a* and sub-guide shaft 103*b* extending in the main-scanning direction A support the carriage 102 slidably along the shafts. The guide shaft 103*a* and sub-guide shaft 103*b* are fixed to a chassis 114 at their two ends. With this arrangement, the carriage 102 can reciprocate in the main-scanning direction.

The printhead 101 discharges ink to print on the printing paper 115. The printing method is an inkjet method of discharging ink by using thermal energy. The inkjet discharge method is to discharge ink by using a heater, but is not limited to this. For example, various inkjet methods may be employed, including a method using a piezoelectric device, a method using an electrostatic device, and a method using a MEMS device.

The encoder sensor 119 reads an encoder scale 120 arranged to be parallel to the main-scanning direction A. By counting position detection signal pulses detected by the encoder sensor 119, a position detection unit 521 (see FIG. 5) detects a position of the carriage 102 in the main-scanning direction A, and a velocity measurement unit 522 (see FIG. 5) measures a velocity.

<Arrangement of Carriage Motor>

Figure 2:
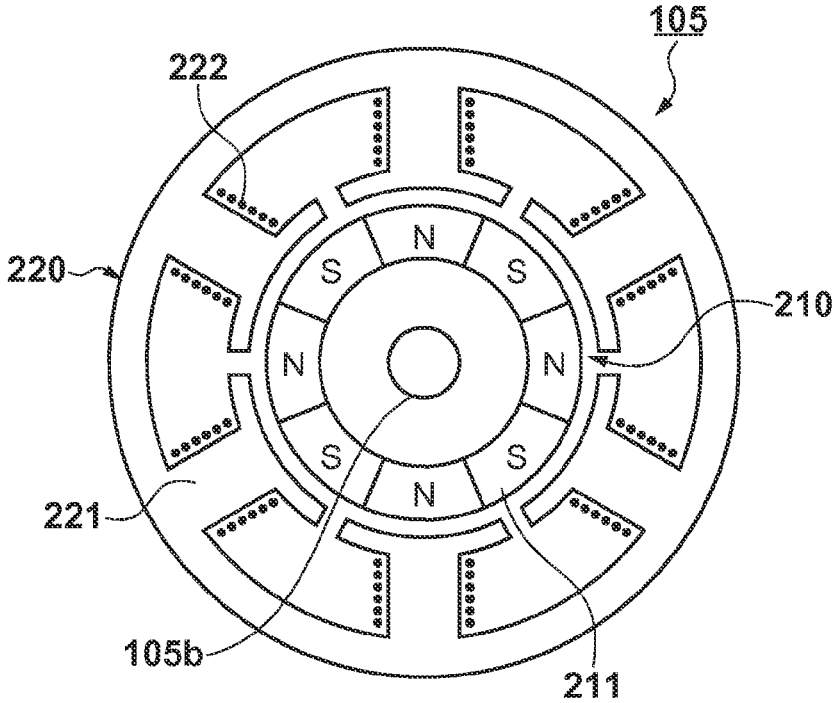
FIG. 2 is a view showing the arrangement of a carriage motor.

FIG. 2 shows the arrangement of the carriage motor 105. The carriage motor 105 in the embodiment is a DC brushless motor. A cylindrical magnet 211 centered on a rotation axis 105*b* is attached to a rotor 210. Four north N poles and four south S poles are alternately arranged at the periphery of the magnet 211. That is, the number of poles of the rotor 210 is P=8. A stator 220 has six slots 221 arranged at equal intervals around the rotor, and a coil 222 is arranged in each slot 221. That is, the number of coils is C=6.

The carriage motor 105 having this arrangement generates a cogging torque containing a plurality of components having different periods. As for these components, when the number of periods per rotation of the carriage motor 105 is defined as an order, the maximum order is $C \times P/2=24$. The cogging torque contains components of periods obtained by dividing the period of one rotation of the carriage motor 105 by multiples of at least one of P/2 and C, that is, components of orders 12, 8, 6, and 4. When the cogging torque is expressed by an order, it is represented by 2 which is the greatest common divisor of the orders of the respective components (that is, the greatest common divisor of the number C of coils and the half P/2 of the number of poles). In other words, the cogging torque has a period obtained by dividing the period of one rotation of the carriage motor 105 by 2.

Figure 3A:
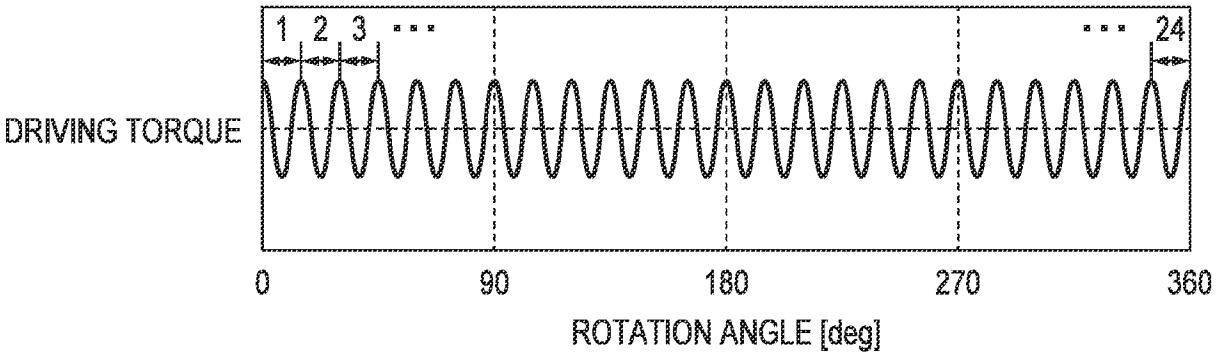
FIGS. 3A, 3B, and 3C are waveform charts each showing the waveform of a driving torque with respect to the rotation angle of the carriage motor.
Figure 3B:
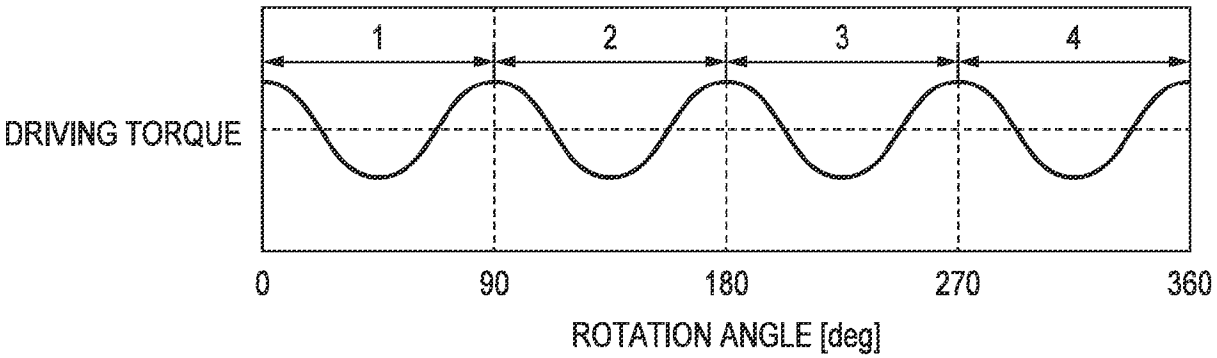
Figure 3C:
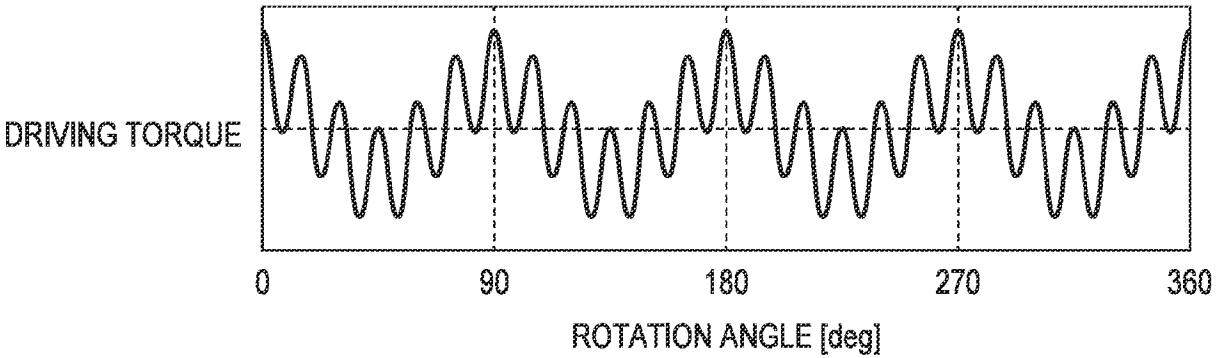

FIGS. 3A to 3C are waveform charts each showing the waveform of a driving torque with respect to the rotation angle of the carriage motor 105. FIG. 3A shows the waveform of a driving torque having a cogging torque component of order 24. FIG. 3B shows the waveform of a driving torque having a cogging torque component of order 4. FIG. 3C shows the waveform of a driving torque containing the cogging torque component of order 24 and the cogging torque of order 4. Since a large number of components impair the clearness of the drawings, two cogging torque components contained in the driving torque are illustrated. In practice, however, the driving torque contains other components.

Note that the amount of ink discharged while the carriage 102 moves in one operation is much smaller than the mass of the entire carriage 102, and the mass of the entire carriage 102 can be considered to be constant. Therefore, the relationship between the driving torque and the velocity of the carriage 102 is linear, and driving torque information can be easily derived from velocity information of the carriage 102.

<Suspension Structure Between Belt 104 and Pulley 105*a*>

Figure 4:
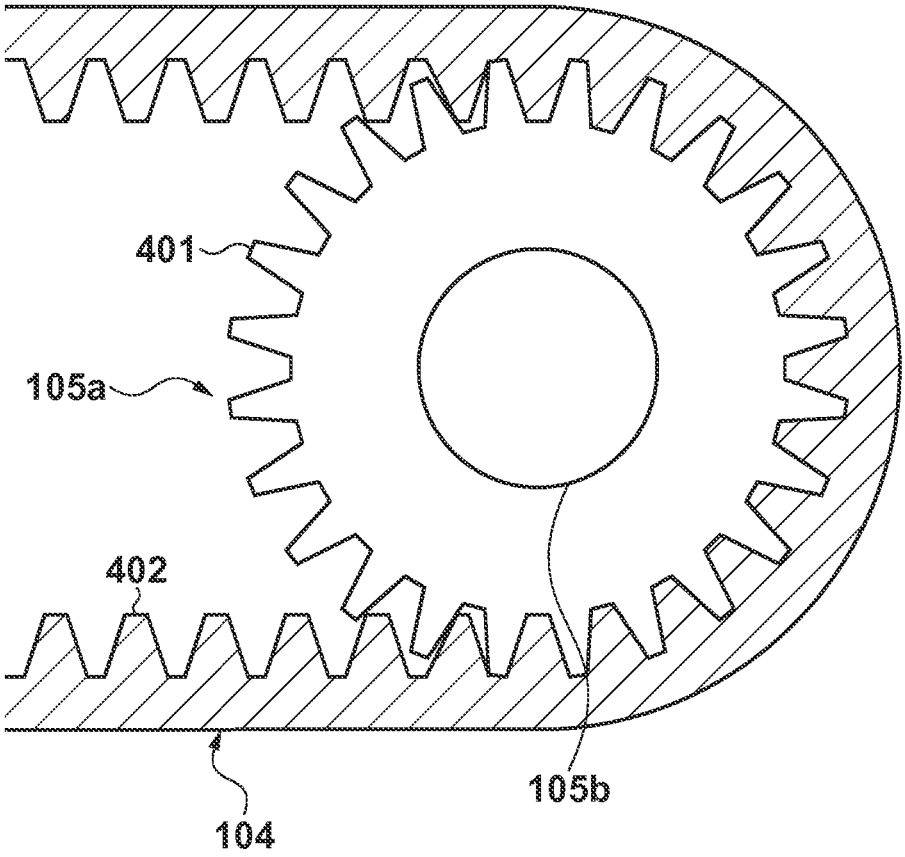
FIG. 4 is a view showing the suspension structure of a belt on a pulley.

As shown in FIG. 1, the belt 104 is suspended between the pulley 105*a*, and the driven pulley 118 which is arranged at a position opposite to the carriage motor 105 in the main-scanning direction A. FIG. 4 is a view showing the suspension structure of the belt 104 on the pulley 105*a*. The pulley 105*a* attached to the rotation axis 105*b* of the carriage motor 105 is a gear member having teeth 401 arranged at equal intervals at the periphery. The belt 104 attached to the carriage 102 has unevenness portions 402 which face the teeth 401 of the pulley 105*a*. The belt 104 is suspended on the pulley 105*a* so that the teeth 401 and unevenness portions 402 are engaged with each other.

The tooth count of the pulley 105*a* matches the maximum order 24 of periodical vibrations caused by the cogging torque. Even if tooth jumping occurs, no phase shift occurs substantially because the phase shift per tooth is 360° for periodical vibrations caused by the cogging torque of order 24. Note that the tooth count of the pulley 105*a* suffices to be a divisor of the product ((P/2)×C) of the number of coils 222 and a number obtained by dividing the number of magnetic poles of the rotor 210 by 2, that is, a divisor of 24. For example, if the tooth count is 12, no phase shift occurs even for periodical vibrations of order 12 in addition to those of order 24. In this manner, as the tooth count decreases, a larger number of components become free from a phase shift even upon generation of tooth jumping. However, if the tooth count is excessively small, smooth engagement between the belt 104 and the pulley 105*a* is lost, the carriage 102 vibrates much more to generate noise, and the parts readily wear to shorten the service life. From this, the tooth count of the pulley 105*a* needs to be designed while securing smoothness of the engagement.

<Functional Arrangement of Inkjet Printing Apparatus>

Figure 5:
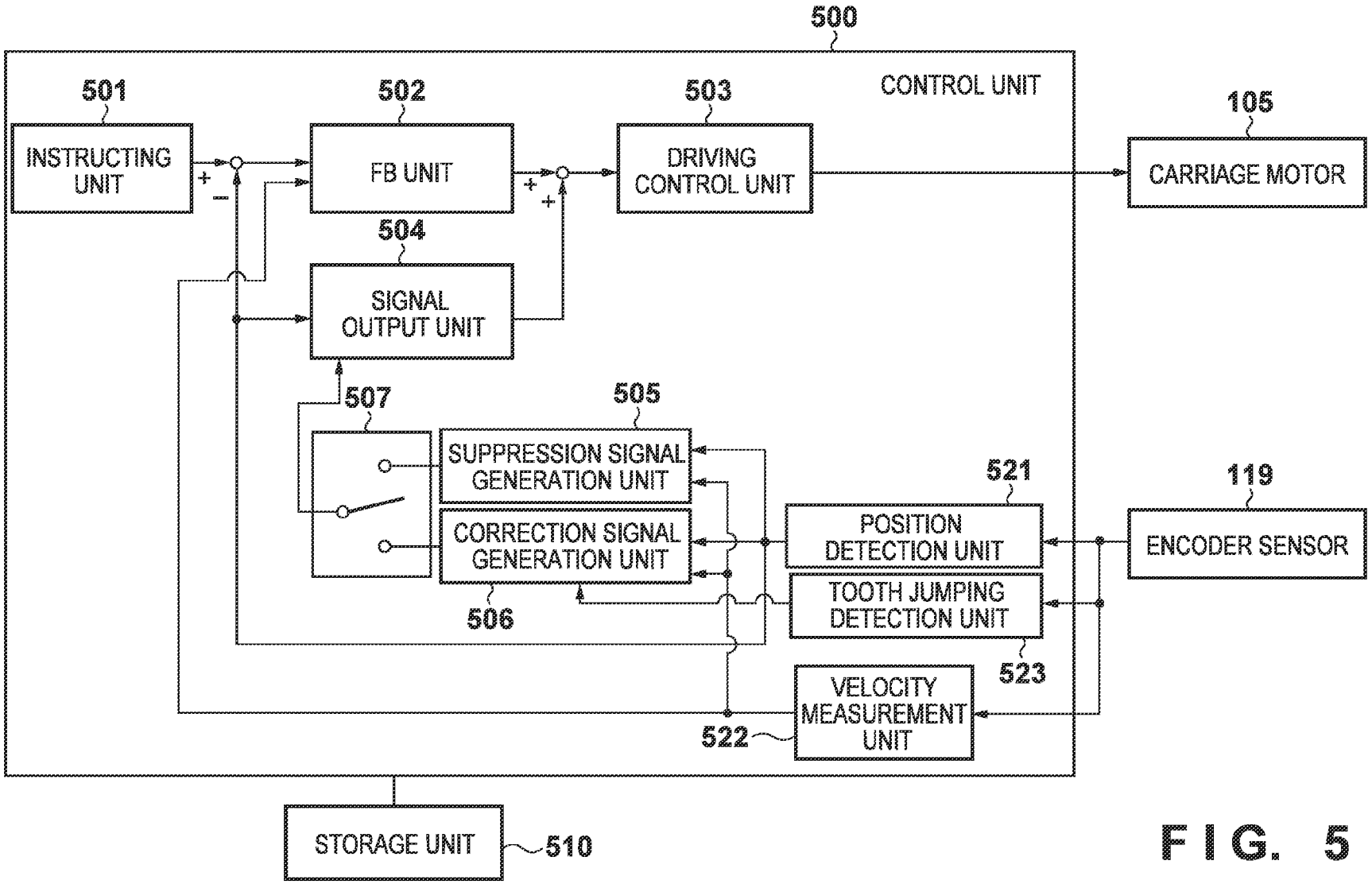
FIG. 5 is a block diagram showing the functional arrangement of the inkjet printing apparatus according to the embodiment of the present invention.

FIG. 5 is a block diagram showing the functional arrangement of the inkjet printing apparatus according to the embodiment. The printing apparatus according to the embodiment includes a control unit 500, a storage unit 510, the position detection unit 521, and the velocity measurement unit 522.

The control unit 500 includes an instructing unit 501, a feedback (FB) unit 502, a driving control unit 503, a signal output unit 504, a suppression signal generation unit 505, a correction signal generation unit 506, a switching unit 507, the position detection unit 521, the velocity measurement unit 522, and a tooth jumping detection unit 523. In the embodiment, various signals are output as voltages.

The instructing unit 501 generates an instruction signal which instructs driving of the carriage motor 105. A carriage position and velocity obtained from an output from the encoder sensor 119 are fed back with respect to the generated instruction signal, and input to the FB unit 502.

The FB unit 502 outputs a feedback (FB) signal from the instruction signal and the carriage position and velocity so that the operation of the carriage 102 matches the instruction value.

The signal output unit 504 outputs a suppression signal generated by the suppression signal generation unit 505, and a correction signal generated by the correction signal generation unit 506. The signals output from the signal output unit 504 are added to the FB signal, and the driving control unit 503 drives the carriage motor 105 based on the added signal. The switching unit 507 selects which of the suppression signal and correction signal is to be output. Methods of generating a suppression signal and correction signal will be described later.

The storage unit 510 includes a non-volatile memory such as a ROM which stores various programs and the like for operating the printing apparatus, and a volatile memory such as a RAM which stores various parameters and the like for executing programs.

As described above, the position detection unit 521 and velocity measurement unit 522 perform position detection and velocity measurement, respectively, of the carriage 102 based on a signal from the encoder sensor 119.

The tooth jumping detection unit 523 detects idle running of the carriage motor 105, that is, tooth jumping between the belt 104 and the pulley 105*a* from the waveform of pulses which have been detected by the encoder sensor 119 during movement of the carriage 102. More specifically, when the interval between detected pulses does not fall within a predetermined range, tooth jumping is detected.

<Suppression Signal Generation Method and Processing>

The suppression signal is a signal which cancels velocity fluctuations of the carriage 102 arising from the cogging torque, and is a function of the position of the carriage 102. An ideal suppression signal waveform is a waveform (waveform of an opposite phase) obtained by shifting the driving torque waveform by half the period.

Figure 6:
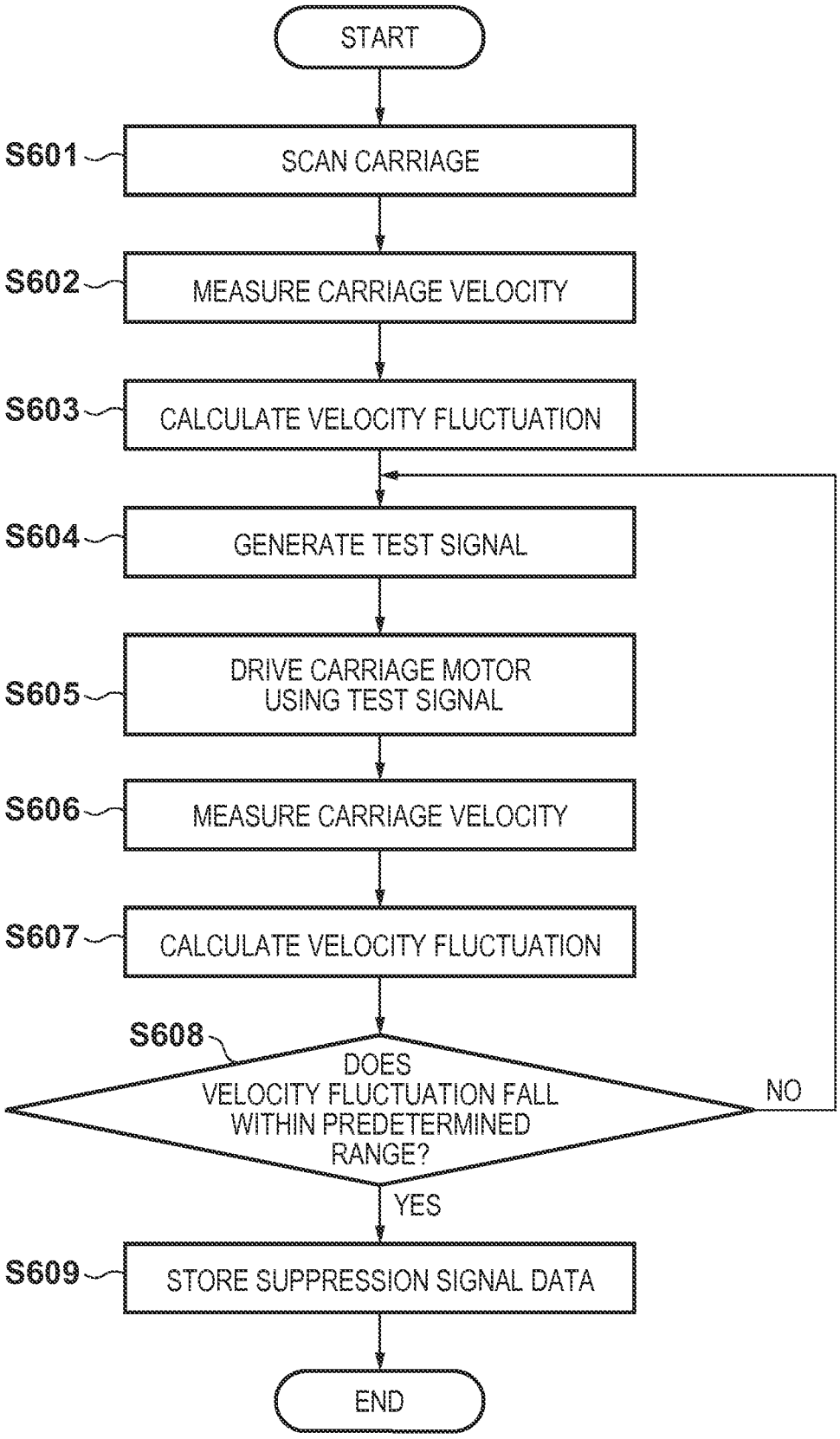
FIG. 6 is a flowchart showing processing for generating a suppression signal.

FIG. 6 is a flowchart showing processing for generating a suppression signal.

In step S601, the driving control unit 503 scans the carriage 102 based on the instruction signal. In step S602, the velocity measurement unit 522 measures the velocity of the carriage 102 in the scanning range. Although the minimum scanning length is one period of the suppression signal, the scanning length preferably corresponds to a plurality of periods of the suppression signal in order to secure the measurement precision. At this time, an actual velocity of the carriage 102 exhibits a value different from the instructed velocity owing to the influence of the cogging torque. In step S603, the suppression signal generation unit 505 calculates the difference (velocity fluctuation) between the carriage velocity measured upon scanning the carriage 102, and the instructed velocity. In step S604, a test signal is generated from the calculated velocity fluctuation.

In step S605, the carriage motor 105 is test-driven using the test signal. The velocity measurement unit 522 measures the velocity of the carriage 102 in step S606, and calculates the velocity fluctuation in step S607. In step S608, the suppression signal generation unit 505 determines whether the velocity fluctuation falls within a predetermined range. If the velocity fluctuation does not fall within the predetermined range (NO in step S608), the process returns to step S604 to generate a test signal again. If the velocity fluctuation falls within the predetermined range (YES in step S608), the test signal at this time is decided as the suppression signal. In step S609, a voltage value for each predetermined angle corresponding to one period of the decided suppression signal is stored as signal data in the storage unit 510.

The process for generating a suppression signal is presumed to be performed in the assembly of the apparatus. Thus, the suppression signal has to be generated with few parameter information. Considering this, no severe constraint is imposed on the time taken to generate the suppression signal, and it is more important to reliably suppress velocity fluctuations of the carriage 102.

The period of the generated suppression signal is the same as that of the cogging torque, and is a period obtained by dividing the period of one rotation of the carriage motor 105 by 2. The suppression signal contains a component having the same period as that of each cogging torque component. A suppression signal component having the same period as that of a cogging torque component of order Z will be referred to as a periodic signal of order Z. That is, the suppression signal is a signal obtained by combining a plurality of periodic signals having different periods.

The processing described here is merely an example, and the present invention is not limited to this method. If a velocity fluctuation waveform can be predicted, data for generating a suppression signal may be stored in advance in the ROM or the like at the manufacturing stage of the apparatus without performing the above-described processing.

<Correction Signal Generation Method>

The generated suppression signal is a function of the position of the carriage 102, and can effectively suppress velocity fluctuations of the carriage 102 unless the relationship between the rotation angle of the carriage motor 105 and the position of the carriage 102 changes. However, if the belt 104 and pulley 105*a* shift from each other, this suppression signal cannot effectively suppress velocity fluctuations, and may increase velocity fluctuations instead.

To prevent this, the correction signal is generated using data which has been stored in the storage unit 510 by the processing of FIG. 6. The correction signal has a waveform obtained by shifting the phase of the suppression signal by an amount corresponding to a tooth jumping count (an amount corresponding to an integer multiple of the tooth interval of the pulley 105*a*). To generate the correction signal, the tooth jumping count between the belt 104 and the pulley 105*a* needs to be obtained.

FIG. 7 is a table showing a phase shift between each cogging torque component and a corresponding periodic signal with respect to the tooth jumping count. Although the tooth count of the pulley is 24, the maximum tooth jumping count is 12 in FIG. 7 because the periods of the cogging torque and suppression signal are half the period of the carriage motor 105, as described above.

The orders of components contained in the cogging torque are 24, 12, 8, 6, and 4, as described above. For order 24, the phase shift is 0° regardless of the tooth jumping count. For order 12, the phase shift is 180° when the tooth jumping count is odd, and 0° when it is even. From this, the correction signal generation unit 506 generates a signal (to be referred to as f(12, 180)) obtained by subtracting 180° (corresponding to an odd multiple of the interval between the teeth 401) from the phase of a periodic signal of order 12, and a signal (to be referred to as f(12, 0)) obtained by subtracting 0° (corresponding to an even multiple of the interval between the teeth 401). The driving control unit 503 drives the carriage motor 105 based on the generated signals f(12, 180) and f(12, 0). The velocity measurement unit 522 measures the velocity of the carriage 102 under control based on each of the signals f(12, 180) and f(12, 0). Further, the correction signal generation unit 506 acquires, from the measured velocities, the amplitudes of velocity fluctuation components (velocity fluctuation components of order 12) having the same period as that of the cogging torque components of order 12, and compares the amplitudes at the respective signals f(12, 180) and f(12, 0). By this comparison, it can be decided which of even and odd numbers is the tooth jumping count (which of obtained amplitudes corresponds to a smaller signal).

This process will be generalized. Letting N be the tooth count of the pulley 105*a*, and n be the prime factor of N, a phase shift candidate θ(n, i) (i=0, 1, . . . , n−1) at order Z1=N/n satisfies the following equation:

$$\theta(n,i)=(360°/n)\times i \tag{1}$$

The amplitude of a velocity fluctuation component of order Z1 is acquired under control based on a signal obtained by shifting (subtracting) a periodic signal of order Z1 by the phase θ(n, i) (corresponding to the tooth count i). A plurality of (n) amplitudes are acquired, $\theta_n$ is θ(n, i) corresponding to a minimum amplitude out of the acquired amplitudes, and $N_n$ is a shifted tooth count.

Then, attention is paid to order 6 which is ½ of order 12. When the tooth jumping count is odd, that is, θ12=θ(2, 1)=180°, the phase shift at order 6 is 90° or 270°. Thus, similar to order 12, 90° and 270° are subtracted from the phase of a periodic signal of order 6, generating signals f(6, 90) and f(6, 270). The driving control unit 503 drives the carriage motor 105 based on these signals. Velocity measurement, acquisition of velocity fluctuation amplitudes for components of order 6, and amplitude comparison are performed, narrowing down tooth jumping count candidates.

This process will be generalized. When m=2n for the n value, and phase shift candidates at order Z2=N/m are θ(m, j) (j=0, 1), the following equations are satisfied:

$$\theta(m,0)=\theta_n/2 \tag{2}$$

$$\theta(m,1)=\theta_n/2+180° \tag{3}$$

The amplitudes of velocity fluctuation components of order Z2 are acquired under control based on signals obtained by shifting (subtracting) a periodic signal of order Z2 by phases θ(m, 0) and θ(m, 1) (corresponding to tooth counts $N_n$+0 and $N_n$+n). Two amplitudes are acquired, and $\theta_m$ is θ(m, j) corresponding to a smaller one of the acquired amplitudes. $N_m$ is a shifted tooth count. For example, when $\theta_m=\theta_4=270°$ at order Z2=6, there are three candidates 3, 7, and 11 of the tooth jumping count $N_m$ in one period of the suppression signal, that is, among tooth counts of 0 to 12 in FIG. 7. Velocity fluctuation components of orders 12 and 6 can be effectively suppressed regardless of a tooth jumping count corresponding to an amount by which the phase of the suppression signal is shifted. However, for velocity fluctuation components of orders 4 and 8, no suppression signal has been decided.

Hence, $\theta_n$ (that is, $\theta_3$) is decided by the same procedure even for the velocity fluctuation component of order 8. As is apparent from FIG. 7, $\theta_3$ is one of 120°, 240°, and 0°. More specifically, the amplitudes of velocity fluctuations under the control of the carriage motor 105 at f(8, 120), f(8, 240), and f(8, 0) are compared. Assume that $\theta_3=120°$. When $\theta_4=270°$, as described above, a tooth jumping count (to be referred to as M) satisfying all the conditions for components of orders 8 and 6 is only 7 among 0 to 12, and it can be decided that $\theta_6=60°$ for a component of order 4.

In this example, it can be decided that the tooth jumping count M is 7. The correction signal generation unit 506 generates, as the correction signal, a signal obtained by subtracting an amount (210°) corresponding to seven multiples of the interval between the teeth 401 from the phase of the suppression signal.

<Correction Signal Generation Processing>

Figure 8A:
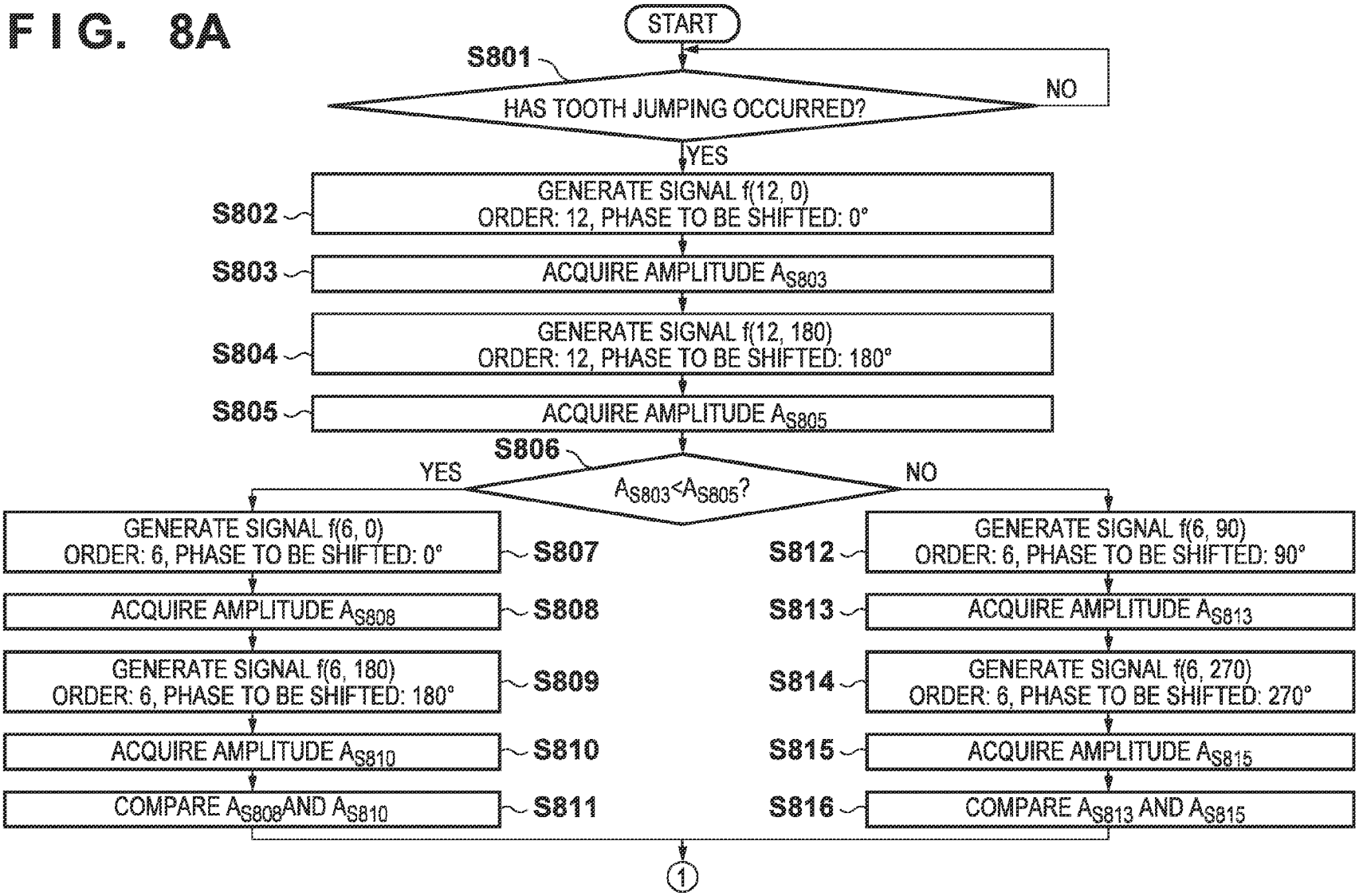
FIGS. 8A and 8B are flowcharts showing processing for generating a correction signal.
Figure 8B:
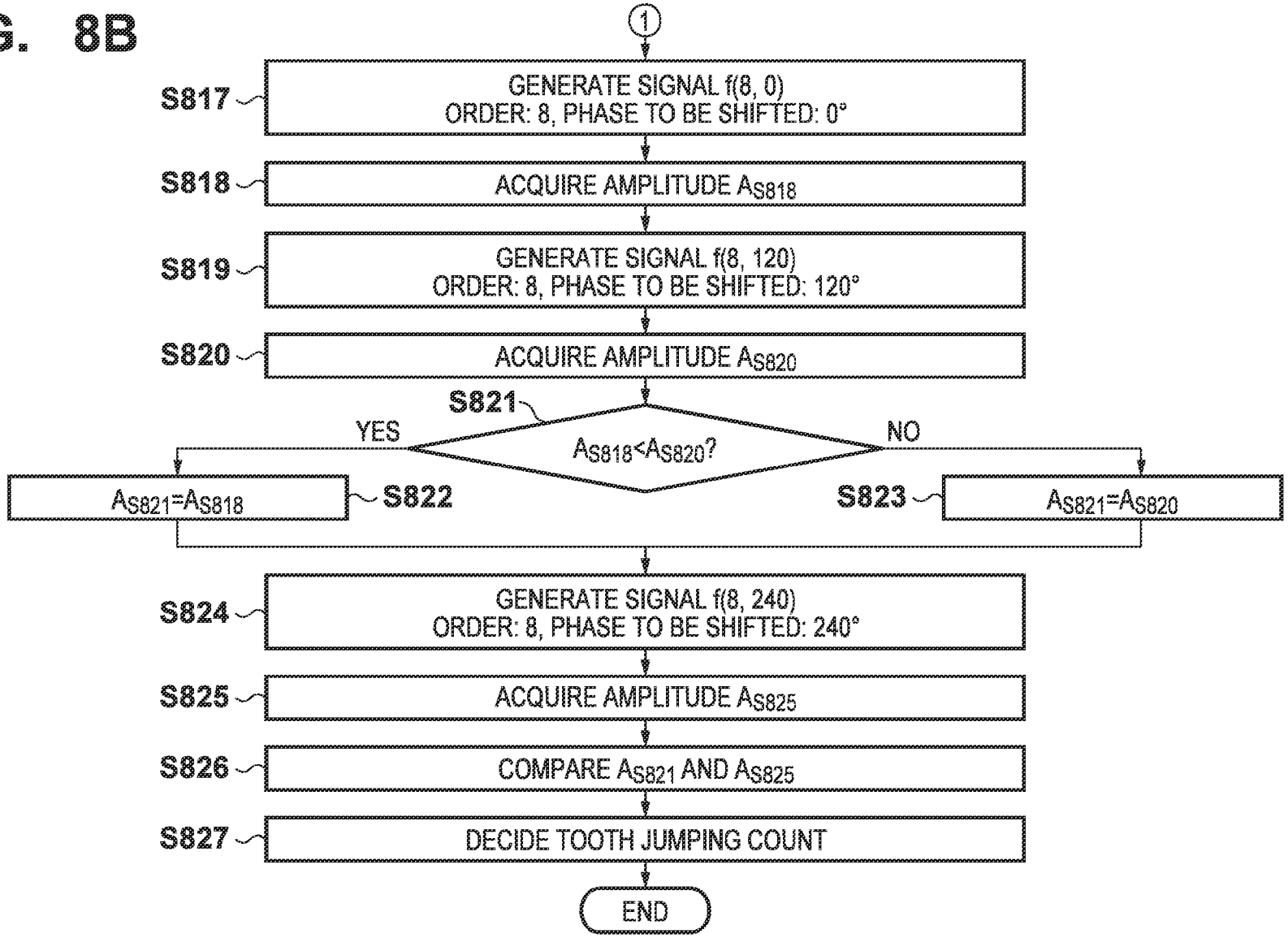

FIGS. 8A and 8B are flowcharts showing processing for generating a correction signal. Detailed processing based on the correction signal generation method will be exemplified.

In step S801, the correction signal generation unit 506 determines whether it has received a signal from the tooth jumping detection unit 523, and determines whether tooth jumping has occurred between the belt 104 and the pulley 105*a*. If tooth jumping has occurred (YES in step S801), the correction signal generation unit 506 generates in step S802 a signal f(12, 0) having the same waveform as that of a periodic signal of order 12 by using suppression signal generation data without shifting the phase. In step S803, the driving control unit 503 drives the carriage motor 105 under control based on the signal f(12, 0). The velocity measurement unit 522 measures the velocity of the carriage 102, and the correction signal generation unit 506 acquires the amplitude of a velocity fluctuation component of order 12. The obtained amplitude will be referred to as $A_{S803}$. Note that the amplitude is acquired by, for example, extracting an amplitude at a target frequency from a velocity fluctuation waveform by fast Fourier transformation (FFT) (this also applies to the following).

In step S804, the correction signal generation unit 506 generates a signal f(12, 180) by subtracting 180° from the phase of a periodic signal of order 12 by using suppression signal generation data. In step S805, the driving control unit 503 drives the carriage motor 105 under control based on the signal f(12, 180). The velocity measurement unit 522 measures the velocity of the carriage 102 at this time, and the correction signal generation unit 506 acquires the velocity fluctuation amplitude of the component of order 12. The amplitude obtained here will be referred to as $A_{S805}$.

In step S806, the correction signal generation unit 506 compares the amplitudes $A_{S803}$ and $A_{S805}$, and decides a phase shifted in the periodic signal of order 12.

If the phase decided in step S806 is 0° ($A_{S803}<A_{S805}$; YES), a phase shift in a periodic signal of order 6 is 0° or 180°, and either phase shift is decided (steps S807 to S811).

If the phase decided in step S806 is 180° ($A_{S803}>A_{S805}$; NO), a phase shift in the periodic signal of order 6 is 90° or 270°, and either phase shift is decided (steps S812 to S816).

In steps S817 to S820, the correction signal generation unit 506 acquires the amplitudes of velocity fluctuation components of order 8 under the control of the carriage motor 105 based on a signal f(8, 0) generated without shifting the phase and a signal f(8, 120) obtained by subtracting 120° for a periodic signal of order 8. The amplitudes obtained here will be referred to as $A_{S818}$ and $A_{S820}$. In step S821, the correction signal generation unit 506 compares these amplitudes. If $A_{S818}<A_{S820}$ (YES), $A_{S821}=A_{S818}$ in step S822. If $A_{S818}>A_{S820}$ (NO), $A_{S821}=A_{S820}$.

In steps S824 and S825, the correction signal generation unit 506 acquires the amplitude of a velocity fluctuation component of order 8 under control based on the signal f(8, 240) generated by subtracting 240° from the phase for a periodic signal of order 8. The amplitude obtained here will be referred to as $A_{S825}$.

In step S826, the amplitude $A_{S821}$ for which a smaller one of the amplitudes $A_{S818}$ and $A_{S820}$ compared in step S821 is set, with the amplitude $A_{S825}$ acquired in step S825. In step S827, a phase shift in the periodic signal of order 8 is decided, and the tooth jumping count M is decided.

By the above steps, a phase to be shifted is decided for the suppression signal in order to generate a correction signal. After that, the signal output unit 504 outputs the correction signal by using data stored in the storage unit 510 and data of the phase decided by the correction signal generation unit 506. The driving control unit 503 controls driving of the carriage motor 105 based on the instruction signal and correction signal, thereby effectively suppressing velocity fluctuations arising from the cogging torque.

Effects of Embodiment

In the arrangement according to the embodiment, the storage unit 510 stores data of a suppression signal which has been generated in advance by the suppression signal generation unit 505 in order to suppress velocity fluctuations of the carriage 102. When tooth jumping occurs, the correction signal generation unit 506 generates a correction signal by shifting the phase of the suppression signal in accordance with the tooth jumping by using the stored suppression signal data. When generating the suppression signal, velocity fluctuations of the carriage 102 need to be measured accurately. Hence, generation of the suppression signal is accompanied by test driving as in step S605 of FIG. 6, and the printing apparatus cannot print during the test driving. To the contrary, the correction signal is generated by correcting (shifting) the phase of the suppression signal in accordance with the tooth jumping count, and no test driving is necessary. Thus, the embodiment can quickly, efficiently suppress velocity fluctuations of the carriage 102 in the printing apparatus.

Further, the embodiment pays attention to the fact that the amount of a shift by tooth jumping between the pulley 105*a* and the belt 104 is discrete. The correction amount of the phase of the suppression signal for generating a correction signal can be selectively decided. For example, if the tooth count of the pulley 105*a* is 24, the tooth jumping count is one of 1 to 24, and the correction amount can be decided from them. By narrowing down tooth jumping count candidates for each order component of velocity fluctuations as in the embodiment, the tooth jumping count can be decided by a small number of steps.

Other Embodiments

The printing apparatus according to the above embodiment acquires the velocity fluctuation amplitude of the carriage 102 for each periodic signal forming the suppression signal, and generates a correction signal while narrowing down tooth jumping count candidates. However, the present invention is not limited to this method, and it suffices to acquire an amplitude and decide a tooth jumping count while discretely shifting the periodic signal. For example, a correction signal generation unit 506 shifts the phase of the suppression signal itself and acquires a velocity fluctuation waveform without decomposition into respective order components, and then acquires the amplitude of a component of a target period from the waveform by FFT.

For example, a case in which an error is generated in the intensity between magnetic poles upon magnetizing a rotor 210, or a case in which a tolerance is generated at the assembly position of a coil 222 and the cogging torque waveform is greatly distorted will be presumed. In this case, the cogging torque waveform is asymmetric. Hence, the period of the suppression signal serves as that of rotation of a carriage motor 105. In this case, the correction signal generation unit 506 acquires the velocity fluctuation amplitude of a carriage 102 without decomposing the suppression signal into respective components, decides a tooth count corresponding to a smallest amplitude as the tooth jumping count, and generates a correction signal.

The tooth count of a pulley 105*a* need not always match the order of a cogging torque component. For example, when the carriage motor 105 in the above-described embodiment and a pulley 105*a*' having a tooth count of 15 are used, if the period of the suppression signal is a period obtained by dividing the period of rotation of the carriage motor 105 by a natural number, the tooth jumping count can be decided by generating signals a maximum of 15 times and comparing velocity fluctuation amplitudes.

Further, the carriage motor 105 is not limited to the DC brushless motor. The above-described correction signal generation method is applicable as long as the velocity of the carriage 102 having a period corresponding to one rotation of the carriage motor 105 fluctuates.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-112684 filed on May 16, 2012, which is hereby incorporated by reference herein in its entirety.

What is claimed is:

1. A printing apparatus which prints while reciprocating, by a motor in a predetermined direction, a carriage on which a printhead is mounted, comprising:

a gear member configured to be attached to a rotor of the motor;

a belt configured to be attached to the carriage, to include unevenness corresponding to teeth of said gear member, and to be suspended to be engaged with said gear member;

a storage unit configured to store data of a plurality of signals having different periods, respectively, for suppressing a velocity fluctuation of the carriage when no tooth jumping occurs between said gear member and said belt;

a detection unit configured to detect generation of the tooth jumping from the velocity fluctuation of the carriage during movement of the carriage; and a correction unit configured to correct the velocity fluctuation of the carriage by using a signal obtained by shifting phases of the respective signals in the stored data by an amount corresponding to the tooth jumping and combining the signals whose phases are shifted respectively when the tooth jumping occurs.

2. The apparatus according to claim 1, wherein said correction unit generates a signal by shifting a phase of the signal for suppressing by an amount corresponding to the tooth jumping.

3. The apparatus according to claim 1, wherein at least one of the signals for suppressing has a period obtained by dividing a period of rotation of the motor by a natural number.

4. The apparatus according to claim 1, wherein the motor includes a DC brushless motor, letting P be the number of magnetic poles of the rotor, and C be the number of coils of the motor, a tooth count of said gear member is a divisor of $(P/2)\times C$, and at least one of the signals for suppressing has a period obtained by dividing a period of rotation of the motor by a multiple of at least one of P/2 and C.

5. The apparatus according to claim 1, wherein at least one of the signals for suppressing is generated based on a velocity fluctuation of the carriage when the carriage is test-driven without printing.

6. The apparatus according to claim 1, further comprising a generation unit configured to generate a plurality of signals shifted by an amount corresponding to an integer multiple of an interval between the teeth, generate, as at least one of the signals for suppressing, a signal having a minimum velocity fluctuation amplitude of the carriage upon driving the motor, and store the signal in said storage unit.

* * * * *